US008146333B2

(12) United States Patent
Fresnel

(10) Patent No.: US 8,146,333 B2
(45) Date of Patent: Apr. 3, 2012

(54) DEVICE FOR PLACING SLEEVES ON TRAVELING ARTICLES

(75) Inventor: Eric Fresnel, Paris (FR)

(73) Assignee: Sleever International Compagny, Morangis (FR)

( * ) Notice: Subject to any disclaimer, the term of this patent is extended or adjusted under 35 U.S.C. 154(b) by 297 days.

(21) Appl. No.: 12/503,872

(22) Filed: Jul. 16, 2009

(65) Prior Publication Data

US 2010/0037558 A1 Feb. 18, 2010

(30) Foreign Application Priority Data

Aug. 14, 2008 (FR) ..... 08 04600

(51) Int. Cl.
*B65B 13/00* (2006.01)

(52) U.S. Cl. ..... 53/585; 53/389.3

(58) Field of Classification Search ..... 53/585, 53/389.3, 389.4, 295; 83/597, 603, 607, 83/663, 946

See application file for complete search history.

(56) References Cited

U.S. PATENT DOCUMENTS

| | | | | | |
|---|---|---|---|---|---|
| 4,179,863 | A | | 12/1979 | Fresnel | |
| 4,765,121 | A | * | 8/1988 | Konstantin et al. | 53/442 |
| 4,922,683 | A | * | 5/1990 | Connolly | 53/296 |
| 5,385,073 | A | * | 1/1995 | Truemner et al. | 83/322 |
| 5,566,527 | A | | 10/1996 | Drewitz | |
| 5,655,427 | A | * | 8/1997 | Infanger | 83/673 |
| 5,970,685 | A | | 10/1999 | Huang | |
| 6,523,331 | B1 | * | 2/2003 | Fresnel | 53/557 |
| 6,684,599 | B1 | * | 2/2004 | Fresnel | 53/64 |
| 6,997,225 | B2 | * | 2/2006 | Hong | 156/459 |
| 7,275,469 | B2 | * | 10/2007 | Chen | 83/13 |
| 7,343,842 | B2 | * | 3/2008 | Chen | 83/597 |
| 2010/0037556 | A1 | * | 2/2010 | Fresnel | 53/218 |

FOREIGN PATENT DOCUMENTS

| | | | |
|---|---|---|---|
| DE | 297 16 624 | U1 | 1/1998 |
| EP | 0 000 851 | A1 | 2/1979 |
| EP | 0 109 105 | A1 | 5/1984 |
| EP | 1 797 984 | A1 | 6/2007 |
| WO | 99/59871 | A1 | 11/1999 |
| WO | 2008/076718 | A1 | 6/2008 |

OTHER PUBLICATIONS

French Search Report for Serial No. 0804600 dated Mar. 10, 2009.

* cited by examiner

*Primary Examiner* — Sameh H. Tawfik
(74) *Attorney, Agent, or Firm* — McCormick, Paulding & Huber LLP

(57) ABSTRACT

The invention relates to a device for placing sleeves on traveling articles, said sleeves being cut from a continuous sheath passing over a sheath-opening shaper, as far as and beyond cutter means, which shaper is held floating between first outer wheels and backing wheels carried by said shaper. In accordance with the invention, the alternating pivoting of the or each blade is ensured by means of a cam system by the difference in rotation between two superposed rotary rings constituting the support for said blade, one of the rings presenting a cam path parallel to the cutting plane and extending in an oblique direction, a cam sliding therein, which cam is constrained to pivot with a blade-carrier by means of a pin parallel to the common axis of the rings and pivotally mounted on the other ring, the or each blade being arranged to pierce the wall of the sheath and to cut said wall by exerting a force thereon that is directed radially outwards.

12 Claims, 5 Drawing Sheets

Fig.9
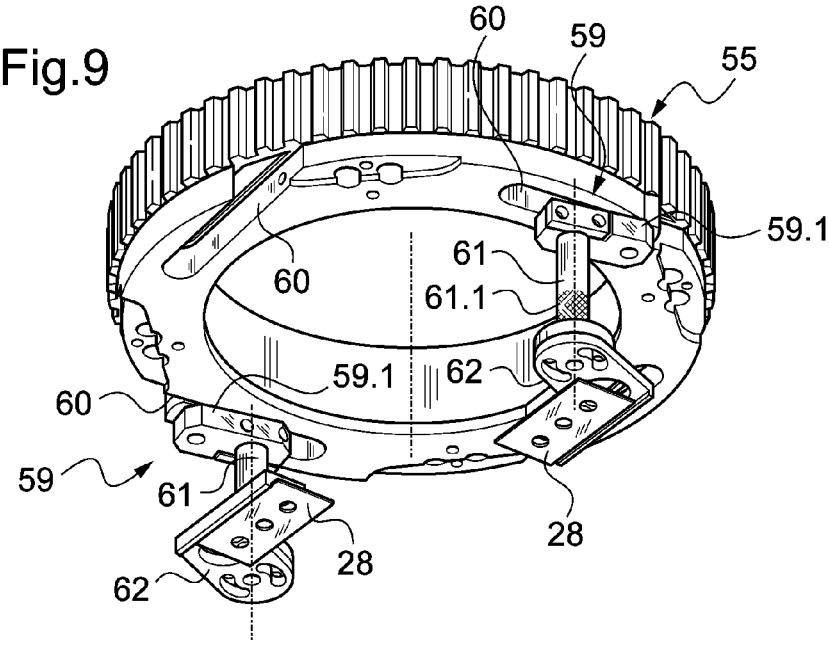
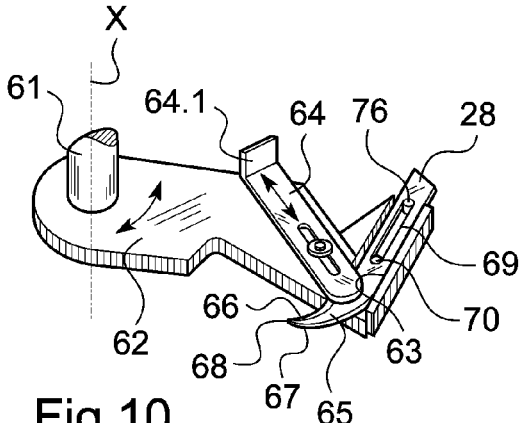
Fig.10
Fig.11
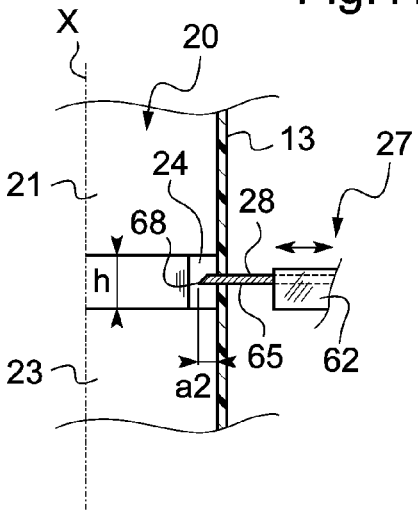

DEVICE FOR PLACING SLEEVES ON TRAVELING ARTICLES

CROSS REFERENCE TO RELATED APPLICATION

Applicant hereby claims foreign priority benefits under U.S.C. §119 from French Patent Application No. 08 04600 filed on Aug. 14, 2008, the contents of which are incorporated by reference herein.

FIELD OF THE INVENTION

The present invention relates to placing sleeves, in particular heat-shrink sleeves, on traveling articles, the sleeve-covered articles then passing through a shrinking oven.

BACKGROUND OF THE INVENTION

To place heat-shrink sleeves on traveling articles, it is conventional to use a technique whereby the sleeves are cut from a continuous sheath that passes over a sheath-opening shaper, which shaper is held floating by co-operation between outer wheels and backing wheels of parallel axes carried by the shaper, which outer wheels serve to cause the sheath to advance along the shaper (which is generally vertical) up to and beyond cutter means. Other wheels are generally provided downstream from the cutter means to eject the segment of sheath that has been cut off onto the article that travels to a position vertically beneath the shaper.

Thus, in most of the techniques used, there are first outer wheels for advancing the sheath over the shaper, and second outer wheels serving to eject the cut-off sheath segments onto the articles in question. All of the outer wheels are naturally motor-driven, and the way they are motor-driven has given rise to various types of arrangement.

Thus, proposals have been made for the motor drive of the first and second wheels to be completely independent so as to enable the second wheels to turn much faster than the first, thereby causing the cut-off sheath segment to drop vertically more quickly onto the article in question. That approach is illustrated in document EP-A-0 109 105. In another approach, the rotary drive of the first and second wheels is synchronized, as shown in document EP-A-0 000 851.

Nevertheless, it has been found that the above-mentioned techniques impose limits in terms of rates of throughput, since when high rates are reached, it is found that the sheaths are frequently poorly positioned on the articles, particularly when they constitute sleeves of considerable height.

More recently, an important advance has been made by a technique implementing synchronous control over the electric motors concerned by means of a common electronic programmer arranged to determine a continuous speed variation profile so as to control the ejection of each sheath segment, said programmer including at least one control card that co-operates with an adjacent coder mounted at the end of a shaft that is driven in rotation by a central motor and gearbox unit. This is illustrated in document WO-A-99/59871 in the name of the Applicant. According to that technique, the synchronization makes it possible to envisage rates of throughput that are higher than before, and this is possible with sleeves of a diameter that is hardly any greater than the maximum diameter of the articles.

Nevertheless, there is an increasing demand for ever higher rates of throughput, commonly reaching values of 300 to 600 strokes per minute.

It is then preferable to use machines that are further improved, abandoning the system whereby articles advance stepwise, and also abandoning the coder system mounted at the end of a shaft driven in rotation by a central motor and gearbox unit (as described in above-mentioned document WO-A-99/59871), and instead to make use of a virtual shaft common electronic programmer for controlling all of the electric motors, with the instruction for ejecting a cut-off sheath segment being given by a cell when the traveling article goes past it.

In parallel with this search for very high rates of throughput, there is also a trend to use sheaths made of heat-shrink film that is of ever smaller thickness. As an indication, conventional techniques used to use heat-shrink films with thickness of the order of 50 micrometers (μm), whereas nowadays it is desired to use films of heat-shrink plastics material that is of smaller thickness, i.e. possibly as little as 25 μm, and that is also of smaller density.

The two above-mentioned requirements thus considerably complicate organizing sleeve-placing devices, and mention can be made of one type of technical problem that is becoming more and more awkward, and this relates to the process of cutting the sheath while it is held stationary on the sheath-opening shaper.

The cutter means traditionally used make use of at least one blade turning about the shaper level with a deep groove in the shaper, which groove is associated with a ligament uniting the two component portions of the shaper, the or each blade being caused to pivot in alternation between its retracted position and its cutting position by means of a circumferential type cam system in which a wheel associated with the or each blade runs along a cam path defined over 360° by coaxial tracks in a stationary ring. It has been found that such an arrangement becomes impractical at very high rates of throughput, and that the rapid wear of the wheels is very difficult to control. By way of example, one such arrangement is shown in FIG. 2.

In addition, during the cutting process, the cutting edge of the blade engages the wall of the sheath at the level of the above-mentioned groove in the shaper, and exerts considerable thrust in order to pass through the wall of the sheath. It has been found that the effect of this radial force is to push the lips beside the cut back into the above-mentioned groove, thereby giving rise to a cut edge that is not perfectly straight but has irregularities, and also to generate an inherent risk of the sheath suffering indentation deformations that necessarily disturb the normal process of the sheath advancing and of the cut-off segment being ejected. This negative effect of the wall of the sheath being pushed back while it is being cut becomes even more acute when sleeves are used that are made of a heat-shrink film that is of small thickness and low density.

The state of the art relating more specifically to systems for cutting a continuous sheath in machines for placing sleeves on traveling articles is also illustrated in the documents mentioned below.

Document U.S. Pat. No. 5,566,527 illustrates a cutter system having a knife blade mounted on a turntable, and engaging the wall of the sheath for cutting in a purely radial manner.

Document DE-A-297 16 624 shows a cutter system having multiple coplanar blades that are actuated individually by pneumatic means. There also, the wall of the sheath is engaged by each blade by exerting a thrust force so as to pass through the blade.

Finally, WO-A-2008/076718 describes two different cutter systems, one with a turntable configuration and the other with a system of superposed rings, in which the difference in rotation acts on a finger for driving each pivoting blade, with the wall of the sheath being engaged in purely radial manner by each blade, thereby resulting in considerable thrust being exerted on said wall. An arrangement analogous to the above-mentioned system is to be found with the same drawbacks in document EP-A-1 797 984.

SUMMARY OF THE INVENTION

An object of the invention is to devise a device for placing sleeves on traveling articles that does not present the above-mentioned drawbacks and limitations concerning the technical problem set out above, relating to the process of cutting the stationary sheath on the sheath-opening shaper.

Another object of the invention is to propose a sleeve-placing device that is arranged to enable very high rates of throughput, possibly as high as 600 strokes per minute, and even with continuous sheaths made from films of small thicknesses, e.g. possibly as small as 25 μm, and of low density, in particular of relative density less than 1.

The above-mentioned problem is solved in accordance with the invention by means of a device for placing sleeves on traveling articles, said sleeves being cut from a continuous sheath passing over a sheath-opening shaper up to and beyond cutter means, the shaper having a central axis, and being held floating between first outer wheels and backing wheels of parallel axes carried by said shaper, up to and beyond cutter means, second outer wheels being provided downstream from the cutter means to eject each cut-off segment of sheath onto an article located vertically under the shaper as a result of said article moving past a cell, the cutter means including at least one blade mounted on a support that is arranged to rotate around the shaper, the or each blade being capable of pivoting on said rotary support and remaining in a plane that is essentially perpendicular to the axis of the shaper, facing a groove in said shaper, and alternating between a retracted position and a cutting position in which it penetrates in part into said groove of the shaper, said device being remarkable in that the alternating pivoting of the or each blade between its retracted position and its cutting position is ensured by means of a cam system by the difference in rotation between two superposed rotary rings constituting the support for said blade, one of the rings presenting a cam path parallel to the cutting plane and of oblique direction, in which there slides a cam that is constrained in rotation with a blade-carrier via a pin parallel to the common axis of the rings and pivotally mounted on the other ring, and in that the or each blade presents a free end that is arranged to pierce the wall of the sheath and to cut said wall while exerting a force (F) thereon that is directed radially outwards.

To this end, provision is made for the or each blade to be arranged in such a manner that its end cuts the wall of the sheath while conserving an orientation such that the tangent to the cutting edge forms an angle (a) with the tangent to the wall of the sheath in the direction of rotation of the support of said blade, which angle (a) is less than 90°. In particular, the angle (a) between the two tangents is selected to be close to 75°.

Thus, the above-mentioned characteristics make it possible to guarantee that the wall of the sheath is initially pierced, and is subsequently cut while being pulled radially outwards without any risk of the lips of the cut being pushed towards the axis of the shaper, with this continuing to apply at the highest rates of throughput and with sheath walls that are very thin.

In a particular embodiment, the free end of the or each blade is in the shape of a hooked beak. Under such circumstances, it is advantageous for the hooked-beak free end of the or each blade to present a cutting edge in the form of a concave arc extending to a tip of said blade, with the other edge thereof being in the form of a convex arc.

In another particular embodiment, the free end of the or each blade presents a cutting edge that is rectilinear, extending in a direction that defines the tangent to the cutting edge.

Also preferably, the or each blade is fastened on its blade-carrier by individual quick-release fastener means. In particular, the individual quick-release fastener means comprise a sliding bar arranged to pass over the blade in order to hold it, or to release said blade in order to enable it to be removed.

It is also advantageous to make provision for the support to carry a plurality of blades that are angularly distributed and arranged to pivot in a common plane.

Under such circumstances, it is then advantageous for the cam system to be arranged in such a manner that the blades pivot synchronously with the same motion between their retracted and cutting positions.

It is then advantageous to make provision for the alternating pivoting of the blades to be adjusted so that the penetration distance of the free ends thereof into the groove of the shaper is just sufficient to guarantee that the blades pass through the wall of the sheath, and in particular is about 2 millimeters (mm) to about 3 mm.

Other characteristics and advantages of the invention appear more clearly in the light of the following description and the accompanying drawings, relating to one particular embodiment.

BRIEF DESCRIPTION OF THE DRAWINGS

Reference is made to the figures of the accompanying drawings, in which:

FIG. 9 is an exploded perspective view of the top support ring for the cutter means, showing more clearly the associated cam mechanism;

FIG. 10 is a perspective view of a cutter blade having a free end in the form of a hooked beak, together with its blade-carrier and its individual quick-release fastener means; and FIG. 11 is a fragmentary view in section on a vertical plane, showing how the cutter blade penetrates into the groove of the shaper during the cutting process.

DETAILED DESCRIPTION OF THE PREFERRED EMBODIMENT

Figure 1:
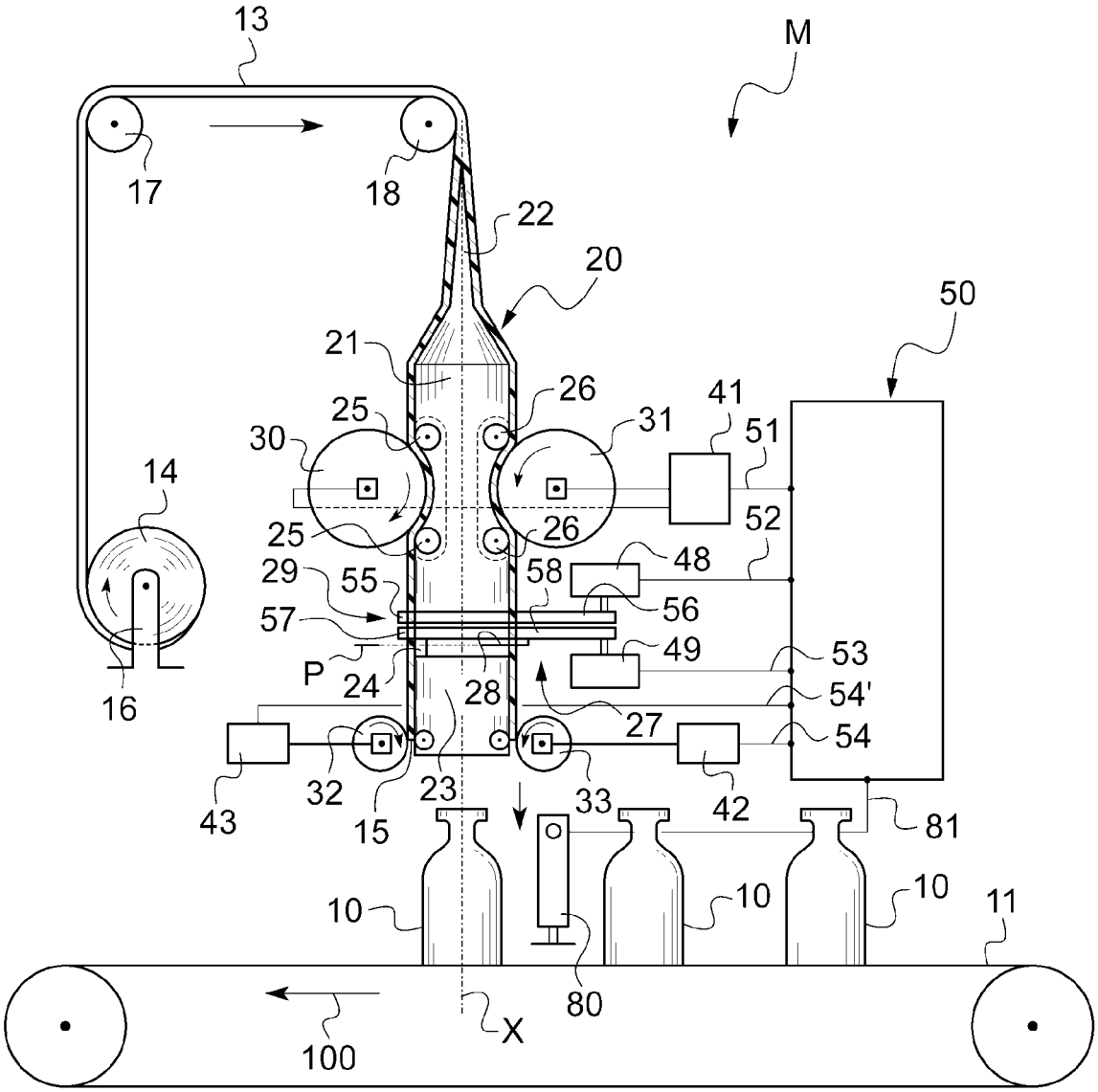
FIG. 1 shows a sleeve-placing device in accordance with the invention, with the various means for imparting rotary drive to wheels that co-operate with the sheath passing over the shaper, here of vertical axis, being represented symbolically, and with a cut-off segment of sheath.

In FIG. 1, there can be seen a sleeve-placing machine referenced M, serving to place sleeves on traveling articles, and arranged in accordance with the invention.

The sleeve-placing machine M has a certain number of points in common with the sleeve-placing machine described in above-mentioned document WO-A-99/59871 in the name of the Applicant. These elements in common are therefore described briefly, however reference can be made to the above-mentioned document for more ample details.

The articles 10, here shown in the form of bottles, are traveling on a conveyor belt 11 in a direction referenced 100, with the travel of the conveyor belt being driven by associated means that are not shown.

A flat sheath of heat-shrink plastics material 13 is delivered from a reel 14 mounted to rotate on a portion of a structure 16, said sheath passing over two deflector rollers 17 and 18 to be brought over a shaper 20 for opening the sheath. The sheath-opening shaper 20, here having a vertical axis X, comprises an upstream central portion 21 surmounted by a flat portion 22 so as to open progressively the continuous sheath 13 arriving on said shaper. The sheath-opening shaper 20 also has a downstream portion 23 that extends the upstream central portion 21, with a groove 24 being formed between them.

Cutter means 27 including at least one moving blade 28 are carried by a rotary support 29 arranged level with the groove 24 for cutting the sheath in response to a given command instruction, cutting taking place circularly in a plane P that is perpendicular to the axis X of the shaper, i.e. specifically essentially horizontal.

The shaper 20 is of the floating type, being held by co-operation between first outer wheels 30 and 31 and backing wheels 25 and 26 of parallel axes that are carried by said shaper.

The continuous sheath 13 thus opens progressively on the upstream portion 21 of the shaper 20 and passes between the wheel 30 and the backing wheels 25, and also between the wheel 31 and the backing wheels 26, respectively, the wheels 30 and 31 thus serving both to provide a floating support for the shaper 20, and on being motor-driven, to perform a function of advancing the continuous sheath 13 along said shaper.

Second outer wheels 32 and 33 are provided downstream from the cutter means 27 for ejecting each cut-off segment of sheath, referenced 15, onto an article 10 located vertically below the shaper 20 as a result of said article moving past a cell 80.

An electric motor 41 is shown diagrammatically that is used for driving the pair of sheath-advance wheels 30 and 31, and two electric motors 42 and 43 are shown for driving the wheels 32, 33 that eject the cut-off segments of sheath.

The cutter means 27 are carried by a rotary support 29 that is made up of two superposed rings 55 and 57 that are driven in rotation, with the difference in their speeds of rotation acting via a special cam system that is described in greater detail below to cause the cutter blade(s) 28 to pivot in alternation between a retracted position and a cutting position. The two superposed rings 55 and 57 are driven via belts 56 and 58 by two electric motors 48 and 49.

The above-mentioned electric motors 41, 42, 43, 48, and 49 are connected via respective associated lines 51, 52, 53, 54, and 54' and by a common electronic programmer 50 to a virtual shaft. The cell 80 that sees each traveling article 10 go past is connected by a line 81 to the common electronic programmer 50 specifically for the purpose of transmitting the signal that authorizes the motors 42 and 43 that are associated with ejecting the cut-off segment of the sheath onto the article 10 located vertically below the shaper 20 to be set into operation. General synchronization is provided by the virtual-shaft common electronic programmer 50 that includes at least one electronic control card 55 having multiple commands that is connected to the above-mentioned command lines 51, 52, 53, 54, and 54'.

There follows a description in greater detail of the way the cutter means 27 are arranged for cutting the wall of the sheath 13 in the groove 24 of the shaper 20, this cutting pass occurring immediately after the forward movement of the sheath is stopped, and immediately before the cut-off segment of sheath 15 is ejected.

Figure 2:
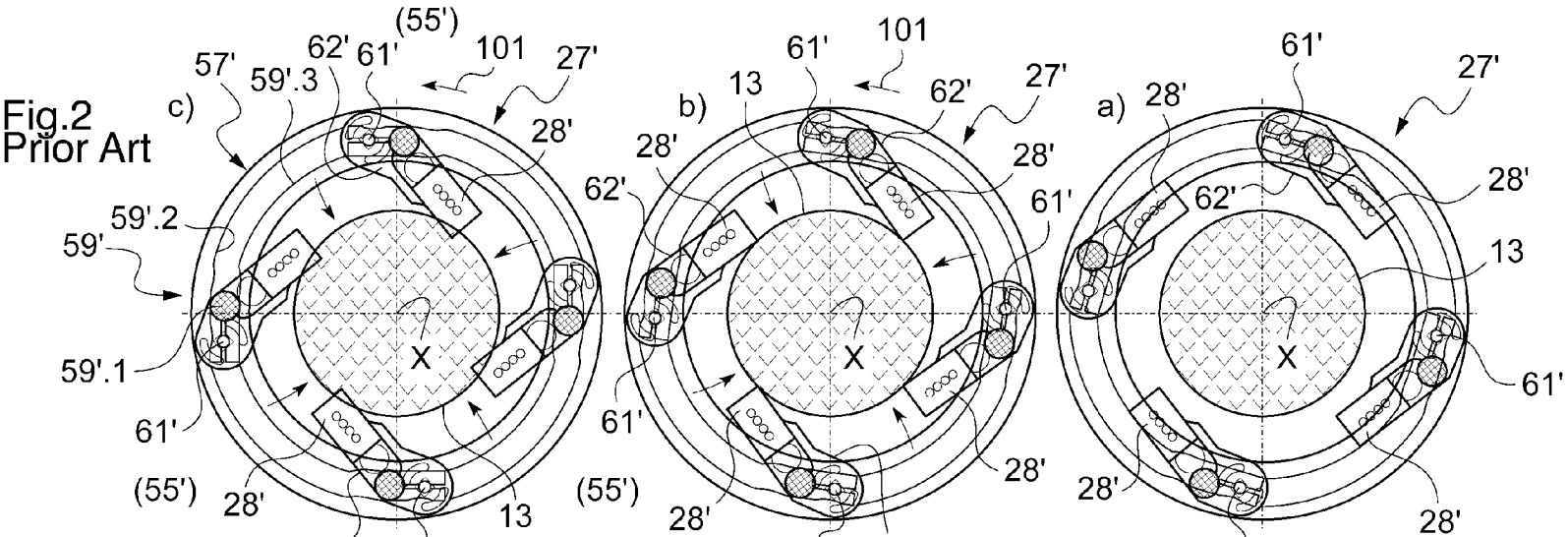
Fig.2 Prior Art
FIG. 2 is a view from beneath showing the cutter means and their rotary supports, with alternating pivoting being ensured by a circumferential type cam system, in accordance with the prior art, showing respectively at a) the cutter blades in the retracted position, at b) the position for piercing the wall of the sheath, and at c) the position for cutting said wall.

In order to understand better the method of operation of the cutter means used in the sleeve-placing device in accordance with the invention, the description below begins by describing a traditional type of arrangement with reference to FIG. 2.

The cutter means 27' is then constituted by a plurality (here four) razor blades 28' arranged to pivot in a common plane, which is the cutting plane. Each blade 28' is mounted on a blade-carrier 62' having an axis 61' that is mounted to pivot on a rotary ring 55', and the blades 28' pivot synchronously with the same motion between their retracted positions and their cutting positions.

The alternating pivoting of each blade 28' between its retracted position and its cutting position is driven by means of a circumferential type cam system 59' in which a wheel 59'.1 associated with the blade-carrier 62' of each blade 28' travels along a cam path defined over 360° by coaxial tracks 59'.2 and 59'.3 of a stationary ring 57'. At a), the four blades 28' are in the retracted position. At b) and at c), rotation of the rotary ring 55' in the direction 101 serves to entrain the wheels 59.1, and the sliding thereof along the circumferential cam path causes said wheels to pivot and causes the associated blade-carriers 62' to pivot therewith. As mentioned above, such an arrangement is not compatible with very high rates of throughput, and the wear on the wheels 59'.1 is fast and difficult to control.

The invention serves to remedy that limitation by the arrangement whereby the alternating pivoting of the or each blade 28 between its retracted position and its cutting position is driven by means of a cam system 29 by the difference in rotation between two superposed rotary rings 55 and 57 that constitute the support for said blade, with one of those rings (here the top ring 55) presenting a rectilinear cam path 60 parallel to the cutting plane P and extending in an oblique direction, having slidable therein an elongate cam 59.1 that is constrained to rotate with the blade-carrier 62 by means of a pin 61 that is parallel to the axis X that is common to the rings 55 and 57, and that is pivotally mounted on the other rotary ring 57.

The support of the cutter means 29 is thus constituted by two superposed rotary rings 55 and 57 that are driven to rotate about the axis X (arrow 101), with the alternating phase difference between these two rings generating the motion of the blade-carriers 62 by means of the cam system 59 that is connected to the pin 61, which pin is coupled to an associated sliding cam 29.1 passing along a cam path 60 arranged in the upper ring 55. This arrangement can be seen more clearly in the fragmentary view of FIG. 9, where the other ring 57 is not shown, the shaded zone 61.1 of the pin 61 here symbolizing said other ring 57 by the zone where said pin is pivotally mounted in said ring. The ring 57 is thus practically identical to the ring 55, but it does not have the four oblique and rectilinear cam paths 60.

Figure 3:
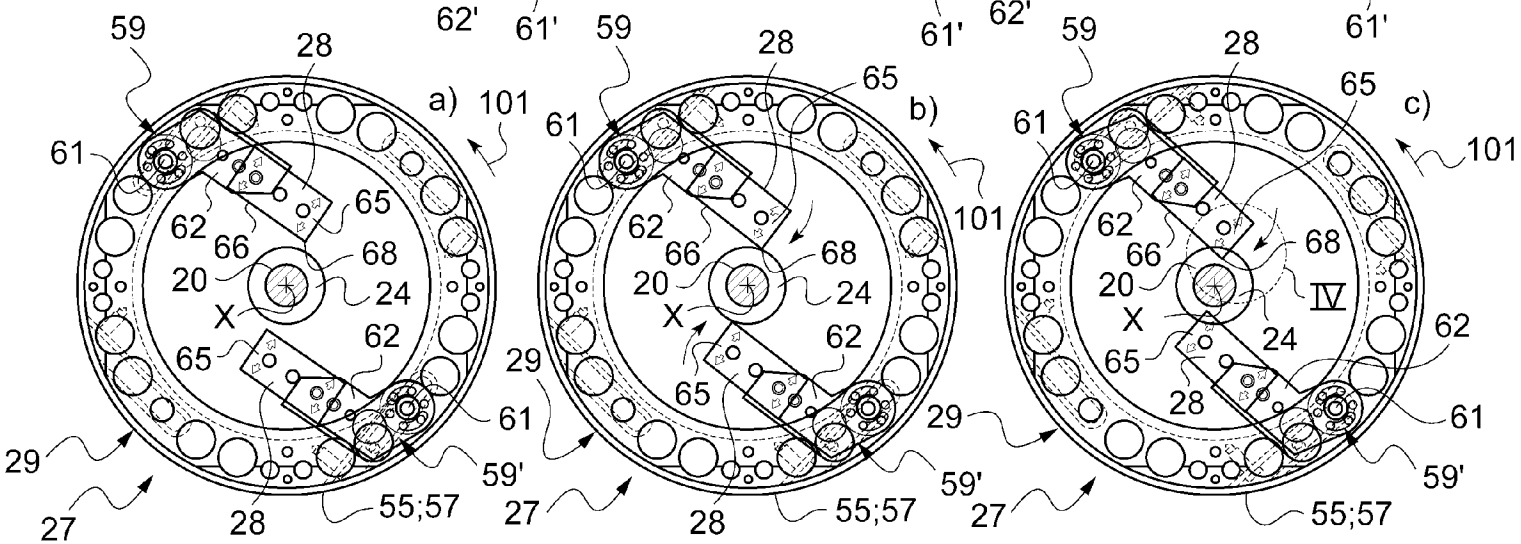
FIG. 3, together with a detail IV shown in greater detail in FIG. 4, is a view analogous to that of FIG. 2 for a similar arrangement of the cutter means, but fitted to a sleeve-placing device of the type of the invention, with alternating pivoting that is ensured by a cam system associated with two superposed rotary rings.

FIG. 3 shows a traditional type cutter system that is suitable for fitting to the sleeve-placing device of the above-described type, with a) showing the two blades 28 in the retracted position, i.e. the tip 68 at the end of the blade 65 is at a distance (e.g. 3 mm) from the wall of the sheath 13, facing the groove 24 in the shaper 20.

At b), the tip 68 of each blade 28 comes into contact with the wall of the sheath 13 so as to pierce said wall.

At c), each blade 28 is in the cutting position.

Figure 4:
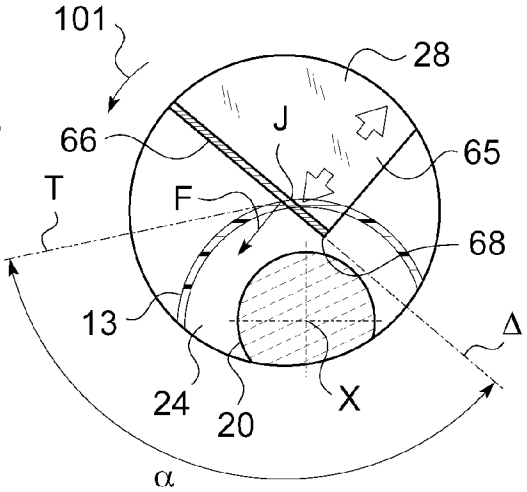

Reference is now made to the detail of FIG. 4, in which there can be seen the leading point J of the blade 28 which in this example has a cutting edge 66 that is rectilinear. The angle of orientation of the blade 28 is specifically such that, at said point J, the tangent (half-line D) to the cutting edge of the blade forms an angle a with the tangent (half-line T) to the wall of the sheath 13 in the direction of rotation 101, which angle a is obtuse, and is specifically about 130°. This demonstrates that the blade 28 then applies a force F on the wall of the sheath 13 at the point J, which force is directed towards the inside of the groove 24, thereby illustrating the unfavorable thrust effect mentioned above.

Figure 6:
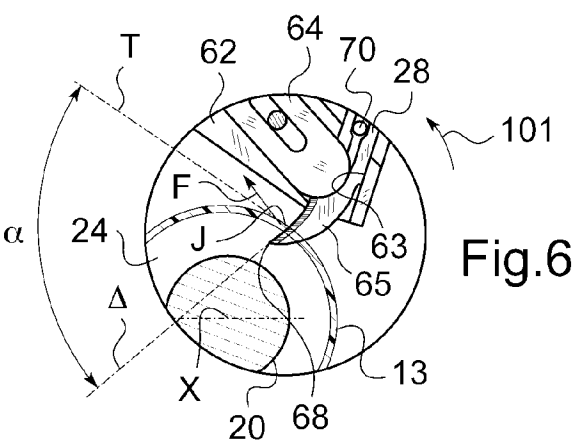
Figure 5:
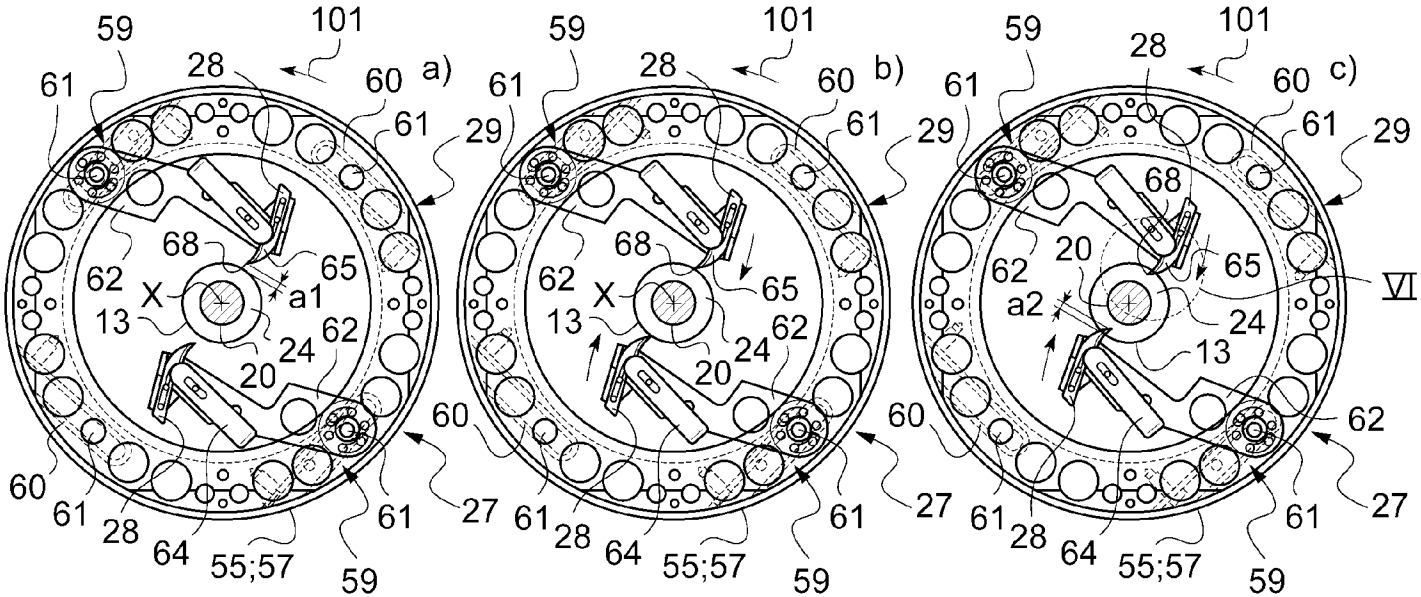
FIG. 5 together with a detail VI shown on a larger scale in FIG. 6 shows a sleeve-placing device in accordance with the invention, in which the arrangement of the blade (here having its free end shaped like a hooked beak) is particular, and produces an outward pulling effect on the wall of the sheath during cutting, by appropriately adjusting the free end that is shaped like a hooked beak.
Figure 7:
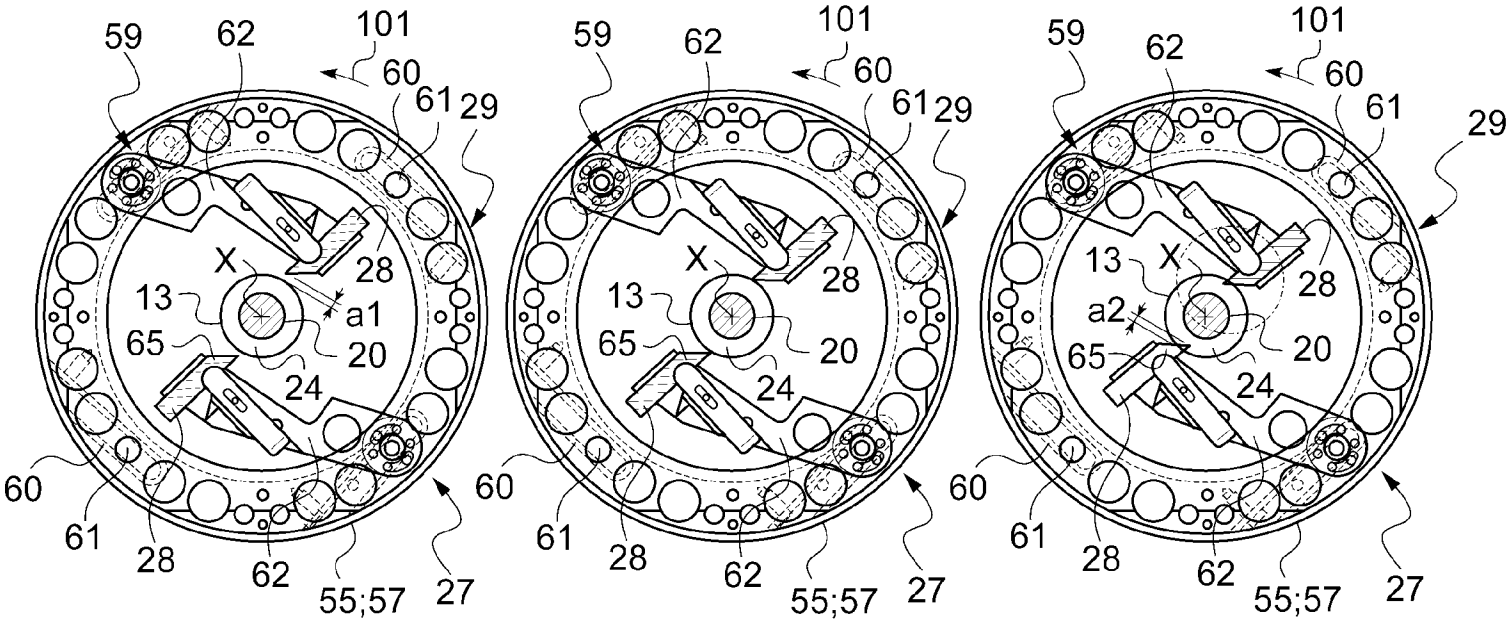
FIG. 7 together with a detail VIII shown on a larger scale in FIG. 8 shows a variant providing the same pulling effect as above, but with a blade having a straight cutting edge.
Figure 8:
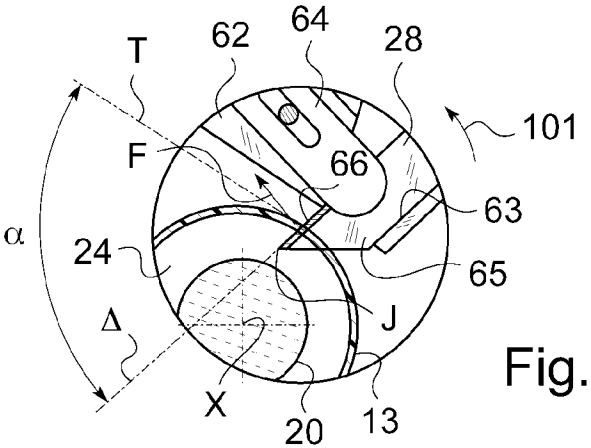

To remedy this, the invention proposes a solution giving better performance, described in two embodiments given as non-limiting examples, and shown respectively in FIGS. 5, 6, and 10, and in FIGS. 7 and 8, in which each blade 28 has a free end 65 that is arranged to pierce the wall of the sheath 13 and to cut said wall, while exerting thereon a force F that is directed radially outwards.

Thus, the arrangement of the free end of each blade 28 is such that the wall of the sheath 13 is initially pierced, and then cut while being pulled radially outwards during the rotation of the blade support around the axis X of the shaper 20, thereby avoiding each cutting lip being pushed into the groove 24 with the above-mentioned drawbacks associated with prior techniques.

The first way of performing these two functions of cutting and pulling the cut wall in a radially outward direction consists in providing for the free end, referenced 65, of the or each cutter blade 28 to have a hooked-beak shape, as shown in FIGS. 5, 6, and 10.

This hooked-beak shape can clearly be seen in FIGS. 6 and 10, where it can be seen that the hooked-beak free end 65 presents a cutting edge 66 in the form of a concave arc extending to a tip 68 of the blade, and having an opposite edge 67 (not sharp) that is in the form of a convex arc. Each blade 28 is mounted on its blade-carrier 62, being held in a slideway 63 associated with said blade-carrier by pegs 70 of the blade-carrier being received in an oblong slot 69 of the blade 28. Each blade 28 is thus arranged to pivot about an axis X1 that is parallel to the axis X of the shaper, the alternating pivoting motion of the blade 28 taking place between a rear or retracted position in which the tip 68 is not in contact with the wall of the sheath 13, and a cutting position in which said tip 68 has passed through the wall of the sheath for cutting and has penetrated a little into the associated groove 24 of the shaper 20.

In FIG. 10, it can be seen that the blade 28 is fastened to its blade-carrier 62 by quick-release fastener means, here constituted by a sliding bar 64 arranged to pass over the blade 28 so as to hold it, or to release said blade so as to enable it to be taken away. In FIG. 10, this sliding bar 64 is shown in the holding position, and it suffices to act manually on a projecting tab 64.1 of said bar in order to pull it back and access the blade 28 so as to remove it.

As can be seen more clearly in the view of FIG. 6, the blade 28 is then arranged in such a manner that its hooked-beak end 65 cuts through the wall of the sheath 13 while retaining an orientation such that, at the leading point J, the two above-mentioned tangents T and D form between them an angle a of less than 90°, e.g. close to 75° as shown. The force F exerted on the wall of the sheath at the point J is therefore directed outwards from the groove 24 of the shaper 20, thereby illustrating the traction effect that is obtained and that avoids putting the wall of the sheath into said groove.

Another way of providing the two functions of cutting the wall and of pulling the cut wall radially outwards consists in providing for the free end 65 of the or each blade 28 to present a cutting edge 66 that is rectilinear, extending in a direction that defines the tangent D to the cutting edge, and with the blade occupying a direction that is modified (e.g. by modifying the direction of the slideway 63 of the blade-carrier 62) so as to conserve an angle a that is less that 90°, e.g. lying in the range 60° to 80°, unlike the arrangement of FIGS. 3 and 4 where the cutting edge 66 is straight, but where the angle a is obtuse.

That is shown in FIGS. 7 and 8, where the same references are conserved, and where it can be seen (FIG. 8) that the force F exerted at the point J is outwardly directed.

As can be seen in the detail view of FIG. 11, the pivoting of the blade 28 is adjusted so that the distance the free end 65 of said blade penetrates into the groove 24 of the shaper 20 is just sufficient to ensure that it passes through the wall of the sheath 13. This penetration distance, which is identified by a parameter a2, is about 2 mm to 3 mm, for example, and thus specifically it is close to the separation distance a1 when the blade 28 is in the retracted position (FIGS. 5 and 7, a)). Nevertheless, the setting of this penetration distance should be selected with care if it is desired to obtain the two effects of simultaneously piercing the wall of the sheath and pulling it in an outwards direction. In practice, the penetration distance must not exceed a value of about 3 mm, since otherwise it becomes very difficult to exert the desired traction force F.

In the context of the invention, a support is thus provided that is constituted by two superposed rotary rings 55 and 57 that are driven to rotate about the axis X by the respective belts 56 and 58 that are connected to the outlet shafts of the above-mentioned drive motors 48 and 49. The two superposed rings 55 and 57 are driven to rotate at speeds that are close to each other, with a small alternating phase shift that is controlled in this example by the common electronic programmer 50. It is found that the cam system 59 with its cams 59.1 sliding in their cam paths 60, is arranged in such a manner that a difference in speed of rotation (in one direction or the other) between the rings 55 and 57 imparts motion to each cam of the cam system 59, and consequently causes each blade-carrier 62 to pivot about its axis X1. Thus, the way the angular phase shifts are controlled between the rings 55 and 57 enables very accurate control to be obtained over the pivoting of each of the blades 28 between its retracted and cutting positions. The alternating pivoting of the blades 28 is thus well controlled, both in terms of speed and of position, by the difference in rotation between the two superposed rings 55 and 57.

As can be seen in FIG. 11, the height of the groove 24, referenced h, is selected in such a manner as to enable the blade 28 to penetrate without risk of interference in said groove even at the highest rates of throughput.

This enables a device to be achieved that places sleeves on traveling articles that significantly improves the prior device of document WO-A-99/59871, while significantly improving the quality with which the sheath is cut so as to define each cut-off segment for ejection.

The sleeve-placing machine can be used at very high rates of throughput, e.g. 600 strokes per minute, and with sheaths made of film that is of small thickness, e.g. 25 μm, and of low density, e.g. of relative density less than 1.

The invention is not limited to the embodiment described above, but on the contrary covers any variant using equivalent means to reproduce the essential characteristics set out above.

What is claimed is:

1. A device for placing sleeves on traveling articles, said sleeves being cut from a continuous sheath passing over a sheath-opening shaper up to and beyond cutter means, the shaper having a central axis, and being held floating between first outer wheels and backing wheels of parallel axes carried by said shaper, second outer wheels being provided downstream from the cutter means to eject each cut-off segment of sheath onto an article located vertically under the shaper as a result of said article moving past a cell, the cutter means including at least one blade mounted on a support that is arranged to rotate around the shaper, the or each blade being capable of pivoting on said rotary support and remaining in a plane that is essentially perpendicular to the axis of the shaper, facing a groove in said shaper, and alternating between a retracted position and a cutting position in which it penetrates in part into said groove of the shaper, wherein the alternating pivoting of the or each blade between its retracted position and its cutting position is ensured by means of a difference in rotation between two superposed rotary rings of a cam system constituting the support for said blade, one of the two superposed rotary rings presenting a cam path parallel to a cutting plane and of oblique direction, in which there slides a cam that is constrained in rotation with a blade-carrier via a pin parallel to a common axis of the two superposed rotary rings and pivotally mounted on the other of the two superposed rotary rings, and wherein the or each blade presents a free end that is arranged to pierce the wall of the sheath and to cut said wall while exerting a force thereon that is directed radially outwards.

2. The sleeve-placing device according to claim 1, wherein the or each blade is arranged in such a manner that its end cuts the wall of the sheath while conserving an orientation such that the tangent to the cutting edge forms an angle with the tangent to the wall of the sheath in the direction of rotation of the support of said blade, which angle is less than 90°.

3. The sleeve-placing device according to claim 2, wherein the angle between the two tangents is selected to be close to 75°.

4. The sleeve-placing device according to claim 2, wherein the free end of the or each blade is in the shape of a hooked beak.

5. The sleeve-placing device according to claim 4, wherein the hooked-beak free end of the or each blade presents a cutting edge in the form of a concave arc extending to a tip of said blade, with the other edge thereof being in the form of a convex arc.

6. The sleeve-placing device according to claim 2, wherein the free end of the or each blade presents a cutting edge that is rectilinear, extending in a direction that defines the tangent to the cutting edge.

7. The sleeve-placing device according to claim 1, wherein the or each blade is fastened on its blade-carrier by individual quick-release fastener means.

8. The sleeve-placing device according to claim 7, wherein the individual quick-release fastener means comprise a sliding bar arranged to pass over the blade in order to hold it, or to release said blade in order to enable it to be removed.

9. The sleeve-placing device according to claim 1, wherein the support carries a plurality of blades that are angularly distributed and arranged to pivot in a common plane.

10. The sleeve-placing device according to claim 9, wherein the cam system is arranged in such a manner that the blades pivot synchronously with the same motion between their retracted and cutting positions.

11. The sleeve-placing device according to claim 10, wherein the alternating pivoting of the blades is adjusted so that the penetration distance of the free ends thereof into the groove of the shaper is just sufficient to guarantee that the blades pass through the wall of the sheath, and in particular is about 2 mm to about 3 mm.

12. A device for placing sleeves, which are cut from a continuous sheath, on traveling articles, comprising:

a shaper adapted to open the continuous sheath, the shaper having a central axis, and being held floating between first outer wheels and backing wheels of parallel axes carried by said shaper;

a cutter including at least one blade mounted on a support that is arranged to rotate around the shaper, the at least one blade being capable of pivoting on said rotary support and remaining in a plane that is essentially perpendicular to the axis of the shaper, facing a groove in said shaper, and alternating between a retracted position and a cutting position in which it penetrates in part into said groove of the shaper;

the support comprising a cam system that includes a first ring and a second ring, which are superposed and rotate about a common axis, the first ring defining a cam path parallel to a cutting plane and in a direction oblique to the radius of the first ring;

a cam disposed in the cam path of the first ring;

a blade carrier for holding the at least one blade, the blade carrier being connected to the cam by a pin oriented parallel to the common axis of the first and second rings, the pin being pivotally mounted on the second ring;

second outer wheels being provided downstream from the cutter means to eject each cut-off segment of sheath onto an article located vertically under the shaper as a result of said article moving past a cell, wherein the alternating pivoting of the at least one blade between its retracted position and its cutting position is controlled by rotating the first ring and second ring at different speeds and with an alternating phase shift with respect to each other; and wherein the or each blade presents a free end that is arranged to pierce the wall of the sheath and to cut said wall while exerting a force thereon that is directed radially outwards.

* * * * *